United States Patent [19]

Macriss et al.

[11] Patent Number: 4,493,364

[45] Date of Patent: Jan. 15, 1985

[54] FROST CONTROL FOR SPACE CONDITIONING

[75] Inventors: Robert A. Macriss, Deerfield; Jaroslav Wurm, North Riverside; Vincent M. Huang, Skokie, all of Ill.

[73] Assignee: Institute of Gas Technology, Chicago, Ill.

[21] Appl. No.: 325,970

[22] Filed: Nov. 30, 1981

[51] Int. Cl.[3] ..... F28D 13/00

[52] U.S. Cl. ..... 165/1; 62/57; 62/80; 62/272; 62/284; 165/95; 165/104.16; 237/2 B; 237/81; 55/269

[58] Field of Search ..... 165/104.16, 95, 1; 62/272, 284, 57, 80, 52; 422/139-147; 237/2 B, 81; 55/268, 269

[56] References Cited

U.S. PATENT DOCUMENTS

| | | | |
|---|---|---|---|
| 2,852,545 | 9/1958 | Jenny | 165/104.16 |
| 3,814,176 | 6/1974 | Seth | 165/104.16 |
| 3,912,002 | 10/1975 | Elliott | 165/104.16 X |

FOREIGN PATENT DOCUMENTS

| | | | |
|---|---|---|---|
| 860105 | 2/1961 | United Kingdom | 165/104.16 |
| 754195 | 8/1980 | U.S.S.R. | 165/104.16 |

*Primary Examiner*—Albert W. Davis, Jr.
*Attorney, Agent, or Firm*—Thomas W. Speckman

[57] ABSTRACT

An apparatus and process for frost control for the ambient air heat exchanger of a space conditioning apparatus. The ambient air heat exchanger is immersed in a fluidized bed enhancing the heat transfer and physically reducing frost formation. In a preferred embodiment, the fluidized bed is supported by a support bed of non-fluidized solid particles. In one of the embodiments the particulate beds may be desiccant materials. The space conditioning apparatus and method of frost control of this invention permits smaller ambient air heat exchangers and accommodates greater transient conditions due to the enhanced heat transfer and physical prevention of ice formation resulting from the fluidized bed.

48 Claims, 2 Drawing Figures

Fig. 1.
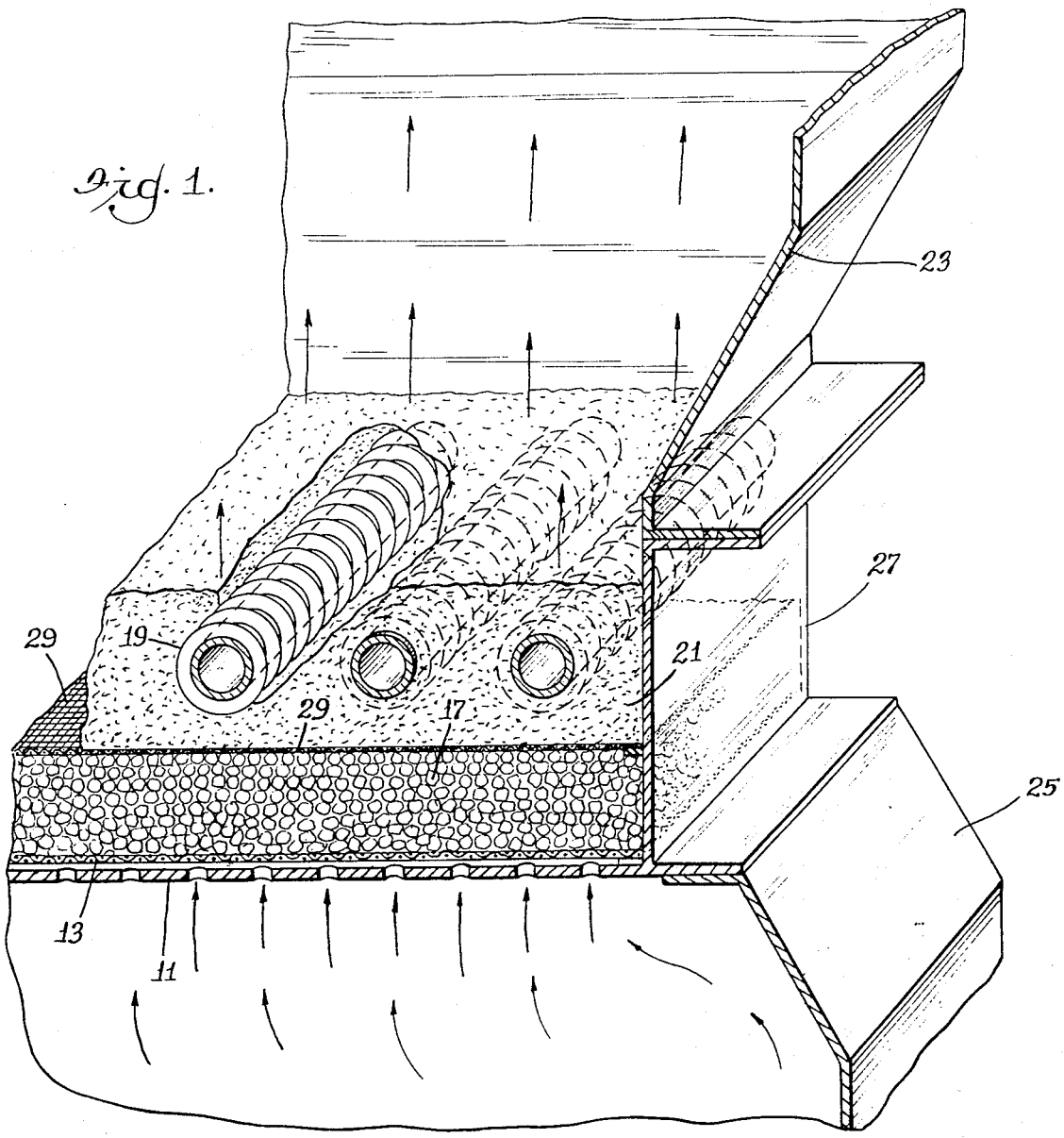
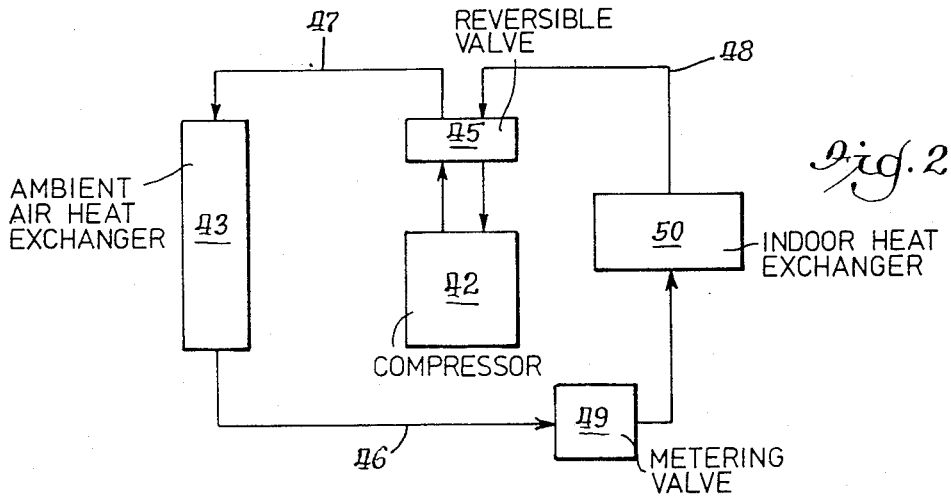
Fig. 2.

FROST CONTROL FOR SPACE CONDITIONING

BACKGROUND OF THE INVENTION

1. Field of the Invention

This invention relates to an apparatus and process for frost control for space conditioning wherein ambient air is passed across a heat exchanger such as in cooling and heating, refrigerator, freezer and dehumidification systems. More specifically, this invention is particularly applicable to heat pump systems for residential and commercial buildings comprising a compressor, a heat exchanger mounted within the interior of the building being conditioned, and an outdoor heat exchanger subjected to ambient air flow. The heat pump system normally includes a four-way valve for reversing the flow of refrigerant. During the cooling mode, the indoor heat exchanger is the evaporator for the system, and the outdoor heat exchanger serves as the condenser. During the heating mode, these two heat exchangers trade functions; the indoor heat exchanger becomes the condenser rejecting heat to the interior of the building, while the outdoor heat exchanger becomes the evaporator picking up heat from the ambient air passing through the outdoor coils. More specifically, this invention relates to an improved outdoor heat exchanger wherein the coils of the heat exchanger are contained in a fluidized bed to enhance heat transfer and to diminish or totally eliminate frost formation on the evaporator coils during the heating operation.

When the outdoor heat exchanger functions as an evaporator, particularly at ambient temperatures near freezing, there is a tendency for the moisture within the ambient air stream to condense and freeze on the evaporator surface which is at or below freezing temperature. Prior art solutions to this problem have focused on various methods to periodically defrost the evaporator coils. However, such systems are quite energy inefficient. This invention provides an energy efficient fluidized bed heat exchanger apparatus and system which transfers heat more efficiently and operates frost-free at near freezing ambient temperatures.

2. Description of the Prior Art

There have been many prior attempts to control the frost accumulation on the outdoor heat exchanger of a heat pump operating in the heating mode. One method common in small residential size heat pumps comprises a momentary mode reversal of the heat pump itself, wherein the flow of refrigerant is reversed changing the outdoor heat exchanger from its evaporator function to a condenser function. Defrost of the outdoor heat exchanger is accomplished by the condensation of hot vapor refrigerant in the outdoor heat exchanger. This method is applied by means of several embodiments differing mainly by the defrost control employed and the components utilized. For example, U.S. Pat. No. 4,007,603 teaches the use of a differential pressure switch across the outdoor evaporator to initiate and terminate the defrost cycle; U.S. Pat. No. 4,024,722 teaches defrost control by monitoring the surface temperatures of selected refrigeration components as well as the ambient atmospheric temperature; and U.S. Pat. No. 4,104,888 teaches defrost control by monitoring an operational parameter of the compressor sensitive to frost accumulation, such as compressor current. U.S. Pat. No. 3,024,620 teaches an outdoor heat exchanger configuration that results in decreased defrost time, while U.S. Pat. No. 3,240,028 teaches defrost time reduction by use of an auxiliary coil immersed in a hot oil bath which superheats the hot vapor refrigerant during defrost. U.S. Pat. No. 3,529,659 teaches the use of radiant heat from hot liquid refrigerant returning from the indoor heat exchanger to warm the air flow upstream to the main outdoor heat exchanger; U.S. Pat. No. 4,171,622 teaches the use of a tandem auxiliary outdoor heat exchanger which acts as a defroster during heating operations and a subcooler during cooling operations; and U.S. Pat. No. 4,178,767 teaches automatic fan motor reversal to blow air downward over the evaporator fins to assist gravity in removing water during the defrost cycle to prevent refreezing of condensate following defrost.

Other embodiments comprise use of bypass valves to reduce the defrost cycle time. For example, U.S. Pat. Nos. 3,274,793 and 3,041,845 teach the use of bypass valves to partly bypass the refrigerant metering device to permit a more rapid loading and heating of the outdoor heat exchanger during the first part of the defrost cycle. U.S. Pat. No. 3,068,661 teaches an increase in the operating temperature of the outdoor heat exchanger during defrost by partly bypassing the hot vapor refrigerant around the outdoor coil, thereby increasing the operating pressure of the indoor heat exchanger; and U.S. Pat. No. 4,158,950 teaches the use of bypass valves upon compressor shutdown to allow a free flow of hot vapor refrigerant into the outdoor heat exchanger until the system temperature equalizes.

Evaporator defrosting by refrigerant flow reversal is both energy inefficient and damaging to equipment. For marginally designed heat pump units, the energy consumption for frost control can amount to as much as 10 percent of the seasonable energy consumption.

Another method comprises the use of direct heat to the evaporator coil. For example, U.S. Pat. No. 3,918,268 teaches the use of direct heating means comprising an electrical resistence heater in thermal contact with the fins of the outdoor heat exchanger such that heat is transferred by conduction. Although simpler and less harmful to the compressor, electrical resistence heat defrosting is characterized by slow response, increased energy inefficiency, and is maintenance prone.

Embodiments comprising heat removal from fluidized beds have focused on the high temperature heat transfer from chemical reaction systems. British Pat. No. 587,774 teaches a method for controlling the reaction temperature in a system wherein the reaction zone is in indirect contact with the fluidized bed. U.S. Pat. No. 4,158,036 teaches the use of a secondary fluidized bed to remove heat from the effluent of an upstream high-temperature fluidized reaction bed. U.S. Pat. No. 4,096,909 teaches a fluidized bed process heater structure wherein the coils are mounted horizontally and are supported by the vessel walls.

SUMMARY OF THE INVENTION

This invention provides a frost control apparatus and method applicable to space conditioning systems wherein low temperature ambient air is passed across the evaporator. This invention is particularly well suited for residential and commercial heat pumps. The frost control apparatus of this invention comprises a fluidized bed heat exchanger wherein a fin-tube heat exchanger is contained within a fluidized bed. Frost formation on the evaporator is prevented by the continuous abrasive action of the fluidized bed. Furthermore, with film coefficients of about 35 Btu/hr-°F.-ft$^2$ attained in a fluidized bed heat exchanger, the overall heat transfer coefficient for the evaporator is increased from about 8 Btu/hr-°F.-ft$^2$ in conventional fin-tube evaporators, to about 30 Btu/hr-°F.-ft$^2$ for fin-tube evaporators contained within a fluidized bed. The enhancement of the heat transfer coefficient is not limited to evaporator function. This increase in heat transfer capacitiy also permits the use of smaller heat exchange area for a given heat load during the condenser function.

It is an object of this invention to provide a frost control apparatus which overcomes many of the disadvantages of prior art systems.

It is another object of this invention to enable air to air heat pumps to operate with a higher seasonal coefficient of performance by eliminating the energy inefficient defrost cycles of conventional heat pump systems.

It is yet another object of this invention to enable air to air heat pumps to operate with a higher seasonal coefficient of performance by increasing the heat transfer efficiency of the outdoor heat exchanger.

It is still a further object of this invention to provide a heat pump process comprising the frost control apparatus of this invention.

It is yet another object of this invention to provide frost control for refrigeration and dehumidification systems.

These and other objects, advantages and features of this invention will become apparent from the description together with the drawings.

BRIEF DESCRIPTION OF THE DRAWINGS

FIG. 1 shows a partial perspective sectional view of an apparatus according to one embodiment of this invention; and FIG. 2 is a simplified schematic flow diagram of one embodiment of the system of this invention.

DESCRIPTION OF THE PREFERRED EMBODIMENTS

FIG. 1 illustrates one preferred embodiment of the fluidized bed heat exchange apparatus enclosed in housing 27. The finned-evaporator tubes 19 are contained in fluidized particulate bed 21. Fluidized bed 21 is separated from a non-fluidized support bed 17 by a fine mesh screen 29. The non-fluidized support bed 17 is separated from the distributor support plate 11 by a coarse mesh screen 13. Ambient air is supplied above the threshold fluidization velocity for fluidized particulate bed 21 by a blower means (not shown) directing air through duct 25 to distributor support plate 11. Cooled air leaving the fluidized bed enters the entrainment disengagement zone defined by duct 23 wherein exhaust air is freed of particulates before release to the atmosphere.

FIG. 2 illustrates an embodiment of the process of this invention wherein a reversible refrigeration system of otherwise conventional design includes the fluidized bed outdoor heat exchanger apparatus of this invention in place of the conventional outdoor heat exchanger. During the heating operation, the compressor 42 passes high pressure vapor through the four-way reversible valve 45 and via conduit 47 to the indoor heat exchanger (condenser) 43 where the vapor condenses and rejects heat to the interior. The liquid refrigerant flows via conduit 46 through metering valve 49 to the low pressure fluidized bed outdoor heat exchanger (evaporator) 50 wherein it accepts heat from the ambient air. Low pressure refrigerant vapor returns via conduit 48 through the four-way reversible valve 45 to the low pressure side of the compressor 42.

Conventionally designed outdoor heat exchangers consist of a number of turns of tubing carrying the refrigerant and are usually mounted in a horizontal plane. The tubing carries a plurality of closely spaced metal heat exchange fins which extend perpendicular to the tubing and parallel to one another. In order to accomplish the needed heat exchange, electric motor driven fans are positioned above or below the outdoor coil. The fans operate to force air through the fins of the outdoor coil, thereby increasing the heat transfer between the ambient air and the refrigerant within the heat exchanger tubing.

The improved outdoor heat exchanger apparatus of this invention comprises an extended surface heat exchanger of conventional design mounted within a fluidized bed. Ambient air is blown or drawn upward through the distributor plate, non-fluidized support bed, and the fluidized bed.

Any distributor plate providing low pressure drop while supporting the non-fluidized support bed may be used. Metallic or ceramic distributor plates are suitable. For example, a sintered 316 stainless steel wire mesh laminate distributor plate may be used.

While not necessary, it is preferred to provide a coarse mesh screen above the distributor support plate to prevent particles in the nonfluidized support bed from passing through or becoming wedged in openings in the distributor support plate. Use of the coarse mesh screen above the distributor support plate permits larger openings in the support plate resulting in lower pressure drop across the support plate. The coarse mesh screen is sized to prevent passage of the particles of the support bed. Suitable mesh for the coarse screen for use in the apparatus of this invention is about 30 to about 40.

The non-fludized support bed provides better distribution of incident air flow than that provided by use of a distributor plate alone. To ensure the support bed remains non-fluidized during operation, the solid support particles used in the support bed have a density-diameter relationship which prevents fluidization. Preferably the support bed particles have higher density than the fluidized bed particles and have mean diameters of about 0.5 mm to about 1.5 mm and preferably about 0.70 mm to about 0.85 mm. Preferably the particles are spherical. To reduce the pressure drop through the non-fluidized support bed, the ratio of solid support particle mean diameter to solid fluidization particle mean diameter is about 1 to about 10, and preferably about 2.8 to about 4.8. To further maintain a low pressure drop, the non-fluidized support bed used in this invention has a depth of about 0.1 in. to about 0.5 in. and preferably 0.25 in. to about 0.40 in. Solid support beads of glass or ceramic material are preferred for use in this invention.

While not necessary, it is preferred to have a fine mesh screen between the fluidized bed and the non-fluidized support bed to prevent the smaller particles of the fluidized bed from falling into the non-fluidized support bed. The fine mesh screen is sized to prevent passage of particles of the fluidized bed. Suitable mesh for the fine screen for use in the apparatus of this invention is about 100 to about 120. A second fine mesh screen may be used above the fluidized bed to prevent loss of particulate material. However, it is preferred, to reduce pressure drop across the entire system, to provide an entrainment disengagement zone by increasing the crosssectional area of the air stream to reduce its velocity to below the threshold velocity so that the particles will fall back into the fluidization zone.

The fluidized beds of solid particles for use in the heat exchangers of this invention have a depth, when in the fluidized state, of about 0.25 inch to about 2 inches and preferably of about 0.50 to about 0.75 inch. The shallower fluidized beds are desired for the conservation of power required to maintain their fluidized state. Suitable solid particles for the fluidized beds used in this invention have mean particle diameters of about 0.06 to about 0.60 millimeters and preferably about 0.20 to about 0.30 millimeters. Fluidized beds of solid particles are known to the art for thermal transfer and a variety of materials are known to be suitable. Solid particles of silica and alumina are preferred for use in this invention, but any suitable particulate material enhancing heat transfer may be used. Particle attrition can be controlled by using particles with greater hardness than that of ice. Fluidized beds of the above depths and particle sizes may be maintained in a fluidized state by passing gas streams through them at velocities sufficiently high to maintain proper fluidization. It is preferred that the height of the fluidized bed to particle diameter ratio be about 85 to about 350. Spherical particles are most preferred.

When the air flow reaches the threshold velocity for the specific particulate bed, dependent upon particle density and size and bed depth, the particulate bed "expands" and becomes fluidized. Conversely, the air velocity can reach a velocity above which the particles are carried from the bed. Suitable fluidization velocities can be readily ascertained by one skilled in the art. A blower to provide fluidization velocity may be placed below support plate 11 to push air through the bed or may preferably be placed above the particle disengagement zone to draw air through the bed.

An energy efficient method of frost control on the evaporator exchanger of a heat pump, or the like, is to enhance the heat transfer characteristics of the exchanger sufficiently to permit operation at a temperature difference, $\Delta T$, ($T_{evaporator} - T_{ambient}$) smaller than the difference between ambient dry bulb and dewpoint temperatures necessary to bring about condensation.

With film coefficients of about 35 Btu/hr-°F.-ft$^2$ attained in a fluidized bed heat exchanger, the overall heat transfer coefficient for the evaporative exchanger is increased from about 8 Btu/hr-°F.-ft$^2$ in conventional fin-tube evaporators, to about 30 Btu/hr-°F.-ft$^2$ for fin-tube evaporators contained in a fluidized bed. The optimal heat transfer is obtained at a fluidization velocity between the minimum and maximum fluidization velocities which may be determined empirically. The enhancement of the heat transfer coefficient provided by the fluidized bed heat exchanger permits a substantial reduction in $\Delta T$ required for normal operation. This increase in heat transfer capacity also permits the use of smaller heat exchange area during the condenser function.

Simple enhancement of heat exchanger effectiveness by increasing the overall heat transfer coefficient may not be adequate to control frost formation in those climates where relative humidity levels can reach the 90 percent range during the heating season. However, enhancement of evaporator effectiveness by the fluidized bed approach utilizing abrasive and/or desiccant action can be relied on to cope with such occasional frosting conditions and, hence, protect the evaporator throughout the heating season. The protection of the heat exchange surface from frost or ice formation is enhanced by the continuous abrasive action of the fluidized bed. Abrasive removal of frost is relatively easily accomplished by the mechanical action of a fluidized bed since the ice exists as fine filaments. Ice existing as a continuous film, on the other hand, is more difficult to remove and requires particle momentum considerably greater than ordinarily encountered in conventional fluidization. Increased particle momentum is attained by operating at higher fluidization velocities.

Frosting could be further diminished by drying the ambient air before contact with the evaporator surface. This can be accomplished by using solid desiccant as the fluidized bed particles or by using solid desiccant particles in the non-fluidized support bed. However, energy would be required for desiccant regeneration. Suitable synthetic zeolite desiccants are available in different forms from small pellets to various mesh sized powders.

It will be apparent to one of ordinary skill in the art, upon reading the above disclosure, that the frost control apparatus and process of this invention are applicable to any space conditioning system having an ambient air heat exchanger. By the term "space conditioning" as used throughout this disclosure and the appended claims, we mean cooling and heating systems such as heat pumps, refrigerators, freezers and dehumidifiers. While the above description has emphasized the application to heat pumps, it is readily apparent that the refrigerator, freezer and dehumidification applications may be effected in the same manner. By the terminology "ambient air" heat exchanger as used throughout this disclosure and the appended claims, we mean to include air from the outside atmosphere or room air which may be used for heat input to or rejection from an extended surface heat exchange means connected to such a space conditioning system.

It is an important aspect of our invention in a space conditioning system having an ambient air heat exchanger that a substantially vertical duct means defining a confined passage for the ambient air and has within that duct means a support means extending substantially across the confined passage supporting a plurality of fluidizable solid particles. Blower means capable of fluidizing the fluidizable solid particle bed passes ambient air through the vertical duct means in an upward direction maintaining the fluidizable particle bed in fluidized state during operation. An extended surface heat exchange means for heat transfer connected to the space conditioning system is immersed in the fluidized bed.

The following examples are set forth for specific exemplification of preferred embodiments of the invention are are not intended to limit the invention in any fashion.

EXAMPLE I

From an effective area of heat transfer surface of 300 ft$^2$, as used with conventional heat pump installations, with a fin efficiency of 50 percent, the $\Delta T$ can be expressed as follows:

$$\Delta T = \frac{Q}{a_h \cdot U}$$

where:

$\Delta T = T_{(evaporator)} - T_{(ambient)}$, °F.

$Q$ = Heat load on evaporator, Btu/hr $a_h$ = effective area of heat transfer, ft$^2$ $U$ = overall heat transfer coefficient, Btu/hr-°F.-ft$^2$ For evaporators of conventional design for 50,000 Btu/hr output and U of 8:

$$\Delta T = \frac{50{,}000}{0.5 \times 300 \times 8} = 42°F.$$

For fluidized bed evaporators for 50,000 Btu/hr output and U of 30:

$$\Delta T = \frac{50{,}000}{0.5 \times 300 \times 30} = 11°F.$$

The example presented above shows that with fluidized bed heat transfer, the heat pump can either operate at significantly lower ΔT's, thus reducing significantly the amount of frosting and/or permit reductions in heat transfer area requirements, thereby reducing cost. The optimum compromise between frost control and cost would have to be determined for each particular case. However, the above example shows heat transfer does offer significant reduction in the frosting of the evaporator coil under high moisture cold ambient air conditions.

EXAMPLE II

Field data was obtained for a whole year on a conventional three ton residential heat pump installation located in a Minneapolis, Minnesota residence. This work is described in more detail in Groff, G. C., Reedy, W. R., Investigation of Heat Pump Performance in the Northern Climate Through Field Monitoring and Computer Simulation, ASHRAE Transactions, 84, Part 1, pgs. 767–785 (1978). The total energy consumption for frost control was 1517 kWhr or about 7 percent of the total seasonal heat pump consumption. Based on the reported 3249 operating hours, the equivalent installed power requirement for frost control was estimated to be 0.442 kW. Another 0.124 kW was used by the installed fan power requirement of the outdoor heat exchanger and, therefore, a total of 0.566 kW would be the maximum equivalent power requirement available for the fluidized bed heat exchanger. It is estimated one can provide effective frost control using only 0.166 kW for the fluidized bed heat exchanger. The heat transfer area requirement would be decreased 25 percent, but would require slightly larger frontal area. The net energy savings by incorporating a fluidized bed outdoor heat exchanger is estimated to be greater than 6 percent of the seasonal energy consumption.

The space conditioning apparatus and method of frost control of this invention permits smaller ambient air heat exchangers and accommodates greater transient conditions due to enhanced heat transfer and physical prevention of ice formation resulting from the fluidized bed.

This invention provides a method of frost control in an ambient air heat exchanger of a space conditioning apparatus by passing heat exchange medium of the space conditioning apparatus through an extended surface heat exchanger, the extended surface heat exchanger immersed in a fluidizable bed and passing ambient air in thermal exchange relation to the heat exchanger at sufficient velocity to fluidize the bed thereby enhancing heat exchange between the heat exchange medium and ambient air and reducing tendency of frost formation by physical vibration and abrasive action.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. In a space conditioning apparatus having a low temperature outdoor ambient air heat exchange evaporator in a heating mode, the improvement of said low temperature evaporator comprising:
   - substantially vertical duct means defining a confined passage for said air;
   - support means extending substantially across said passage;
   - a plurality of fluidizable solid particles comprising a fluidizable bed supported on top of said support means;
   - blower means capable of fluidizing said fluidizable bed with said low temperature outdoor ambient air; and
   - extended surface heat exchange means immersed in said fluidizable bed and connected to said space conditioning system to provide passage of heat exchange medium of said space conditioning apparatus therethrough.

2. The space conditioning apparatus of claim 1 wherein said fluidizable solid particles are alumina.

3. The space conditioner apparatus of claim 1 wherein said support means comprises a plurality of non-fluidizable solid particles comprising a support bed on top of a distributor means for supporting said non-fluidizable support bed and for admitting and distributing said ambient air throughout said fluidizable bed.

4. The space conditioning apparatus of claim 3 wherein said non-fluidizable solid support particles are glass.

5. The space conditioning apparatus of claim 3 additionally having a coarse mesh screen separating said support bed from said distributor means.

6. The space conditioning apparatus of claim 3 wherein said non-fluidized support bed has a depth of about 0.1 inch to about 0.5 inch.

7. The space conditioning apparatus of claim 6 wherein said non-fluidized support bed has a depth of about 0.25 inch to about 0.40 inch.

8. The space conditioning apparatus of claim 3 wherein said non-fluidizable solid particles have mean particle diameters of about 0.5 to about 1.5 millimeters.

9. The space conditioning apparatus of claim 8 wherein said non-fluidizable solid particles have mean particle diameters of about 0.7 to about 0.85 millimeters.

10. The space conditioning apparatus of claim 3 wherein the ratio of mean particle diameters of said non-fluidizable solid particles to said fluidizable solid particles is about 1 to about 10.

11. The space conditioning apparatus of claim 10 wherein said ratio of mean particle diameters is about 2.8 to about 4.8.

12. The space conditioning apparatus of claim 3 wherein said non-fluidizable solid support particles are ceramic solids.

13. The space conditioning apparatus of claim 1 wherein said fluidizable bed has a depth, when in the fluidized state, of about 0.25 to about 2 inches.

14. The space conditioning apparatus of claim 13 wherein said fluidizable bed has a depth, when in the fluidized state, of about 0.5 to about 0.75 inches.

15. The space conditioning apparatus of claim 3 wherein said fluidizable bed has a depth, when in the fluidized state, of about 0.25 to about 2 inches.

16. The space conditioning apparatus of claim 1 wherein said fluidizable solid particles have mean particle diameters of about 0.06 to about 0.60 millimeters.

17. The space conditioning apparatus of claim 16 wherein said solid particles have mean diameters of about 0.20 to about 0.30 millimeters.

18. The space conditioning apparatus of claim 3 wherein said fluidizable solid particles have mean particle diameters of about 0.06 to about 0.60 millimeters.

19. The space conditioning apparatus of claim 1 wherein said fluidizable solid particles are silica.

20. The space conditioning apparatus of claim 3 wherein said fluidizable solid particles are selected from the group consisting of silica and alumina.

21. The space conditioning apparatus of claim 1 wherein said extended surface heat exchange means is a fin-tube heat exchange means.

22. The space conditioning apparatus of claim 3 wherein said extended surface heat exchange means is a fin-tube heat exchange means.

23. The space conditioning apparatus of claim 1 wherein said fluidizable solid particles are solid desiccant particles.

24. The space conditioning apparatus of claim 23 wherein said space conditioning apparatus is a heat pump.

25. The space conditioning apparatus of claims 1 or 3 or 5 or 6 or 8 or 10 or 12 or 13 or 16 or 19 or 21 or wherein said space conditioning apparatus is a heat pump.

26. A method of frost control on a low temperature outdoor ambient air heat exchanger functioning as an evaporator in the heating mode of a space conditioning apparatus comprising:

passing heat exchange medium of said space conditioning apparatus through an extended surface heat exchanger, said extended surface heat exchanger immersed in a fluidizable bed; and passing said low temperature outdoor ambient air in thermal exchange relation to said heat exchanger at sufficient velocity to fluidize said bed thereby enhancing heat exchange between said heat exchange medium and ambient air and reducing tendency of frost formation by physical vibration and abrasive action.

27. The method of claim 26 wherein said ambient air is passed through a plurality of non-fluidizable solid particles comprising a support bed on top of a distributor means for supporting said non-fluidizable support bed and for admitting and distributing said ambient air throughout said fluidizable bed.

28. The method of claim 27 wherein said ambient air is additionally passed through a coarse mesh screen separating said support bed from said distributor means.

29. The method of claim 27 wherein said non-fluidized support bed has a depth of about 0.1 inch to about 0.5 inch.

30. The method of claim 27 wherein the ratio of mean particle diameters of said non-fluidizable solid particles to said fluidizable solid particles is about 1 to about 10.

31. The method of claim 27 wherein said non-fluidizable solid support particles are ceramic solids.

32. The method of claim 26 wherein said fluidizable bed has a depth, when in the fluidized state, of about 0.25 to about 2 inches.

33. The method of claim 26 wherein said fluidizable solid particles have mean particle diameters of about 0.06 to about 0.60 millimeters.

34. The method of claim 26 wherein said fluidizable solids particles are silica.

35. The method of claim 26 wherein said extended surface heat exchange means is a fin-tube heat exchange means.

36. The method of claim 26 wherein said fluidizable solid particles are solid desiccant particles.

37. The method of claims 26 or 27 or 28 or 29 or 30 or 31 or 32 or 33 or 34 or 35 or wherein said space conditioning apparatus is a heat pump.

38. The method of claim 36 wherein said space conditioning apparatus is a heat pump.

39. The method of claim 1 wherein said space conditioning apparatus is a heat pump.

40. The method of claim 27 wherein said non-fluidizable solid support particles are glass.

41. The method of claim 26 wherein said fluidizable solid particles are alumina.

42. In a space conditioning apparatus having a low temperature outdoor ambient air heat exchanger, the improvement comprising:

substantially vertical duct means defining a confined passage for said air;

support means extending substantially across said passage comprising a plurality of non-fluidizable solid desiccant particles comprising a support bed on top of a distributor means for supporting said non-fluidizable support bed and for admitting and distributing said ambient air throughout said fluidizable bed;

a plurality of fluidizable solid particles comprising a fluidizable bed supported on top of said support means;

blower means capable of fluidizing said fluidizable bed; and extending surface heat exchange means immersed in said fluidizable bed and connected to said space conditioning system to provide passage of heat exchange medium of said space conditioning system therethrough.

43. The space conditioning apparatus of claim 42 wherein said space conditioning apparatus is a heat pump.

44. The space conditioning apparatus of claim 42 wherein said fluidizable solid particles are solid desiccant particles.

45. The space conditioning apparatus of claim 44 wherein said space conditioning apparatus is a heat pump.

46. A method of frost control on a low temperature outdoor ambient air heat exchanger functioning as an evaporator in the heating mode of a space conditioning apparatus comprising:

passing heat exchange medium of said space conditioning apparatus through an extended surface heat exchanger, said extended surface heat exchanger immersed in a fluidizable bed; and passing said low temperature outdoor ambient air in thermal exchange relation to said heat exchanger through a plurality of non-fluidizable solid desiccant particles comprising a support bed on top of a distributor means for supporting said non-fluidizable support bed and for admitting and distributing said ambient air throughout said fluidizable bed at sufficient velocity to fluidize said bed thereby enhancing heat exchange between said heat exchange medium and ambient air and reducing tendency of frost formation by physical vibration and abrasive action.

47. The method of claim 46 wherein said space conditioning apparatus is a heat pump.

48. The method of claim 46 wherein said fluidizable solid particles are solid desiccant particles.

* * * * *